United States Patent [19]

Adams

[11] 3,949,691

[45] Apr. 13, 1976

[54] AUTOMATIC BACK-TACK MECHANISM

[75] Inventor: Kenneth Douglas Adams, Madison, N.J.

[73] Assignee: The Singer Company, New York, N.Y.

[22] Filed: Apr. 25, 1975

[21] Appl. No.: 571,678

[52] U.S. Cl. ..... 112/210

[51] Int. Cl.[2] ..... D05B 27/22

[58] Field of Search ..... 112/210, 203, 205, 211, 112/213, 215, 262

[56] References Cited

UNITED STATES PATENTS

| | | | |
|---|---|---|---|
| 3,468,273 | 9/1969 | Lester | 112/262 |
| 3,742,881 | 7/1973 | Heine et al. | 112/210 |
| 3,796,172 | 3/1974 | Seiriki | 112/210 |

*Primary Examiner*—Werner H. Schroeder
*Assistant Examiner*—Peter Nerbun
*Attorney, Agent, or Firm*—E. L. Bell; R. E. Smith

[57] ABSTRACT

An automatic back-tack feed control mechanism for the work feed regulating system of a sewing machine which feed regulating system includes a rock shaft and a feed block adapted to influence movement imparted to a feed dog for transporting work fabric transversely of the work surface of the machine according to a selected stitch length. A stitch length selector dial located on the machine includes a reverse feed button connected through a rock arm ultimately to the rock shaft so as to tilt the feed block for reverse feed motion of the feed dog for back tacking. At one preselected stitch length, back tacking is automatic for a predetermined number of stitches since the depression of the reverse feed button actuates a latch lever which locks the rock arm in a reverse feed position until a ratchet mechanism also set in motion by depression of the reverse feed button causes disengagement of the latch lever and rock arm whereby the feed dog is again placed in a forward feed mode. Camming means are also provided so that manual, non-automatic, back tacking can be performed at other selected stitch lengths.

5 Claims, 6 Drawing Figures

AUTOMATIC BACK-TACK MECHANISM

BACKGROUND OF THE INVENTION

This invention relates to an improvement in feed control mechanisms for the work feed systems of sewing machines. Such work feed systems are generally of the drop feed type (known also as fourmotion feeds) where a work engaging feed dog is elevated into work engagement during the feed advancement or reverse stroke and drop out of work engagement during the return stroke, such as disclosed in the U.S. Pat. No. 3,527,183 issued Sept. 8, 1970.

This patent also discloses the manner in which the feed regulating or rock shaft is connected to the work engaging feed dog. As disclosed, the feed regulating or rock shaft is provided with a feed block in which is formed a guide slot. A slide block is positioned to ride within the slot and, in cooperation with a feed advance eccentric mounted on the bed shaft, controls the incremental advance of the feed dog during the work feed stroke. Rotation of the rock shaft determines the angular position of the guide slot and thus the extent of the linear work feed motion transmitted to the feed dog in either forward or reverse feed motion at a selected stitch length. A feed control system for regulating the position of the rock shaft as shown and claimed in the U.S. Pat. No. 3,834,334.

The present invention is specifically directed to improving such feed control mechanisms by providing an automatic means which temporarily reverses the direction of stitching movement for a predetermined number of stitches, i.e. back-tacks, along the stitching path. Such a back-tack may be required for example, at the start and finish of a line of stitching to provide a secure anchorage and prevent the pulling apart of the layers of fabric which may be stitched together.

SUMMARY OF THE INVENTION

The automatic back-tack feed control mechanism of this invention includes a stitch length control cam member positionable by a manually operable selector dial mounted on the machine and connected to a rock arm and ultimately to the rock shaft. The rock arm has a cam follower cooperating with a cam track on the stitch length control cam member for positioning the rock shaft to control the direction and amount of travel of the feed dog. Upon depression of a reverse feed button within the selector dial, the rock shaft is rotated to place the feed dog in a reverse feed motion. In one preselected stitch length position of the selector dial and upon the depressing of the reverse feed button, a second cam on the stitch length control cam member will be positioned for actuation of a latch lever so as to engage the rock arm and lock it in its reverse position for a preselected number of stitches until a ratchet mechanism also actuated by the reverse feed button urges the latch lever out of its lock position whereby the rock arm and rock shaft will return to its forward feed position. The second cam means also prevents the automatic back-tack feature from functioning at all other stitch length settings of the selector dial but permits manual, non-automatic back tacking at these settings.

BRIEF DESCRIPTION OF THE DRAWINGS

In the accompanying drawings of the preferred embodiment.

BRIEF DESCRIPTION OF THE PREFERRED EMBODIMENT

Figures 1, 2, 3:
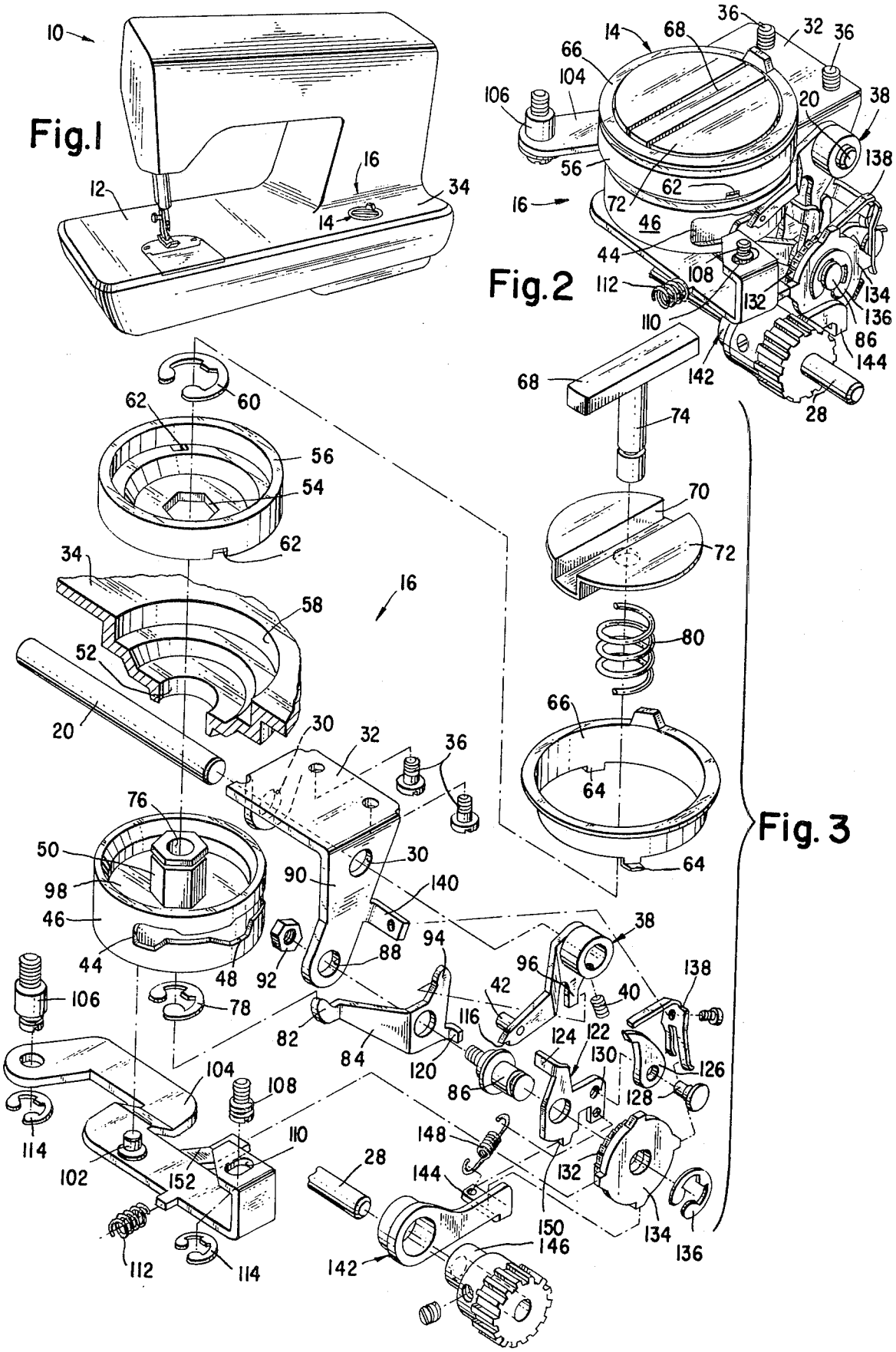
FIG. 1 is a perspective view of a sewing machine in which the automatic back-tack feed control mechanism of this invention has been incorporated.
FIG. 2 is a perspective view of the automatic back-tack feed control mechanism of FIG. 2 to show the details thereof.
FIG. 3 is a disassembled perspective view of the assembly shown in FIG. 2 indicating parts in greater detail and interrelation thereof.

Referring to FIG. 1, a sewing machine is indicated generally by reference numeral 10, with a work support surface 12 forming part of the machine frame and in which can be seen a manually operable selector dial 14 of a stitch or feed control mechanism incorporating the features of this invention, which is shown enlarged and removed from the sewing machine frame in FIG. 2 and indicated in its entirety as 16. This feed control mechanism 16 controls the stitch length and direction of movement of the work fabric across the work supporting surface under control of a feed mechanism. (not shown).

This feed mechanism, as disclosed in the aforesaid U.S. Pat. No. 3,527,183, comprises a feed dog driven through a four motion feed cycle by feed and lift cams responsive to rotation of a bed shaft suitably journalled in the bed of the machine. A feed block connected to a rock shaft indicates the amount and direction of feed advance as selected by the feed control mechanism 16. If a more detailed discussion of this four-cycle motion or of the interrelationship of the elements of the feed mechanism are required, reference can be made to U.S. Pat. No. 3,834,334 as well as to U.S. Pat. No. 3,527,183, supra.

Figure 6:
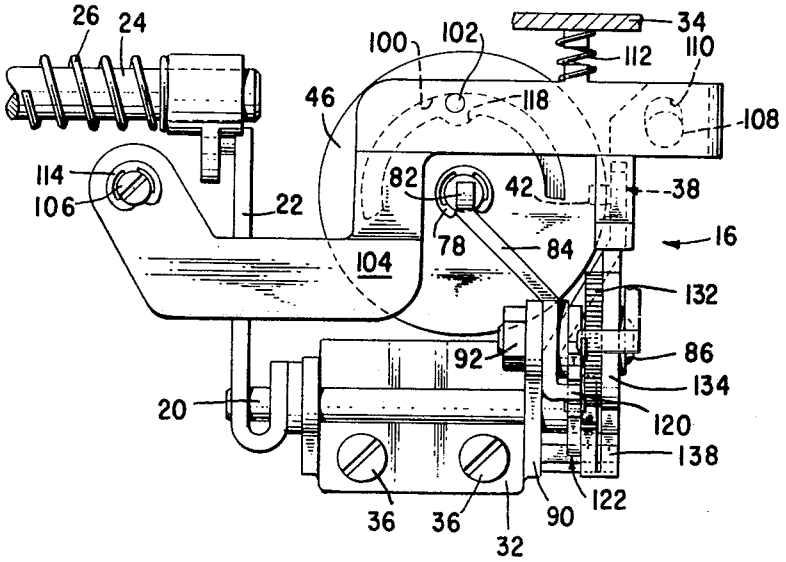
FIG. 6 is an end view of FIG. 4 taken along line 6—6 of FIG. 4 but also showing the linkage connecting the rock shaft to the automatic back-tack feed control mechanism.

In FIG. 3, 20 denotes a relatively short motion transmitting link shaft which is connected through linkage 22 to the feed regulating or rock shaft 24 both of which are clearly depicted in FIG. 6. The rock shaft 24 controls the position or tilt of the aforementioned feed block (not shown), and is biased so that the feed block is normally urged toward a forward feed position by a spring shown schematically at 26.

Turning now specifically to FIG. 3, 28 denotes the previously mentioned bed shaft to which the feed cam and lift cam is connected for actuating the aforementioned feed dog of the work fabric feed mechanism.

Link shaft 20 is journalled through apertures 30 in a U-shaped bracket 32, which is suitably affixed to the bed portion 34 of the machine frame as by machine screws 36. At the end of the link shaft 20 opposite the linkage 22 there is provided a rock arm 38 fixed by set screw 40 to rotate the link shaft. Rock arm 38 is provided with a cam follower 42 which engages a cam track 44 formed on the outer wall of a cylindrical stitch control cam member 46. The position of the stitch control cam member 46 with cam track 44 and cam follower 42 controls the angular position of link shaft 20. Since the link shaft 20 is connected to the rock shaft 24 and the latter is biased by feed block spring 26, link shaft 20 is also biased in the counter-clockwise direction (as shown in FIG. 3) so that the follower 42 will engage the lower work surface 48 of cam track 44. When engaging the lower work surface 48, the rock shaft 4 and its feed block are in a position for forward traverse motion of the feed dog and the relative position of the cam track and follower determines the amount of forward motion of the feed dog, thus determining the stitch length.

The cylindrical stitch control cam member 46 is provided with a central extension 50 having a hexagonal outer surface which extends through a bore 52 in the bed 34 of the machine frame to snugly fit into a cooperating hexagonal aperture 54 in a ring member 56 forming part of the previously mentioned manually operable selector dial 14. The ring member 56 rotates within a cylindrical well 58 in the bed and both the ring member 56 and the cylindrical stitch control cam member 46 are locked together for rotation relative to the bed by E-ring 60. Ring member 56 is, in turn, provided with radially opposite notches 62 to receive similarly situated ears 64 on a selector ring 66 which fit within the ring member 56. Thus assembled, manual rotation of the selector ring 66 will rotate both the ring member 56 and the cylindrical stitch control cam member 46 to locate the cam track 44 relative to the cam follower 42 so as to control the angular position of the link shaft 20 as mentioned previously. The upper surface of the selector ring 66 is calibrated to define the range of stitches available and the numbers thereon correlate with the lobes of the cam track 44 so that the selected location of the selector ring 66 establishes a stitch length and a proportional amount of motion is transmitted to the feed dog.

Figure 4:
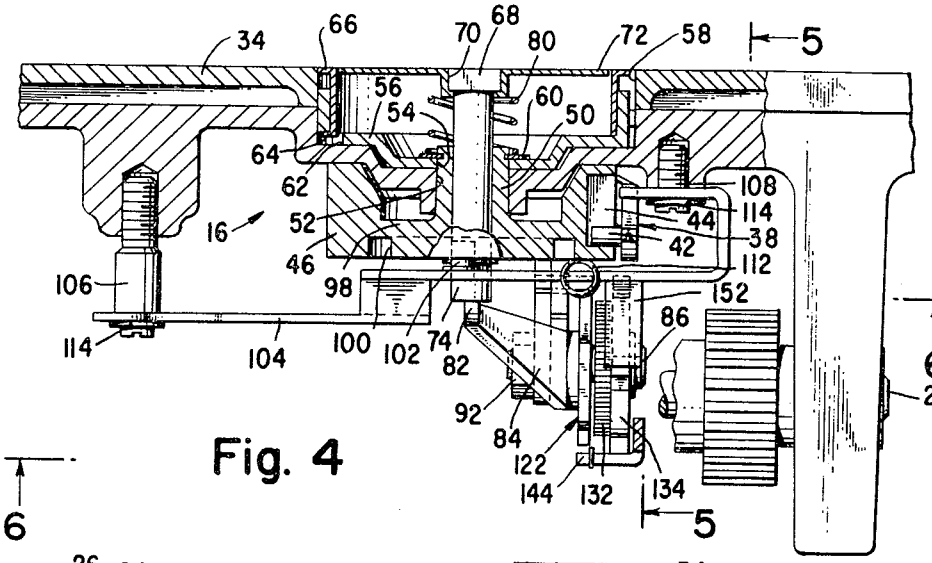
FIG. 4 is an elevational view of the automatic back-tack feed control mechanism partially broken away to show the details of the mechanism.

Located within the selector ring 66 and ring member 56 is a reverse feed button 68 which comprises a horizontal bar disposed within a groove 70 of a cover plate 72 which is apertured to receive a shaft 74 depending from the horizontal bar and which extends downwardly through the bore 52 and hexagonal aperture 54 and into a central axial bore 76 in the central extension 50 of the cylindrical stitch control cam member 46. This entire assembly is locked together by E-ring 78 located below the cylindrical stitch control cam member 46 and the reverse feed button 68 is spring-biased upwardly by the helical spring 80 located below the cover plate 72 and within the bed 34. Such an assembly is more clearly shown in FIG. 4.

To reverse the feed mechanism by depression of the reverse feed button 68, the lower end of the shaft 74 engages a lobe 82 of a reverse feed lever 84 which is pivoted on a stub shaft 86 secured in an aperture 88 formed in a lower arm 90 of the U-shaped bracket 32. The shaft 86 is secured to the U-shaped bracket 32 by any suitable means, such as nut 92, and a second camming lobe 94 on the reverse feed lever 84 is located so as to engage a downwardly extending lug 96 on the rock arm 38. Thus, depression of the reverse feed button 68 against the bias of helical spring 80 will tilt the reverse feed lever 84 counterclockwise (as shown in FIG. 3) so as to tilt the rock arm 38 and the link shaft 20 clockwise. This, in turn, ultimately tilts the feed block aforesaid to reverse the four-cycle motion above-described. In the embodiment shown, the cam follower 42 in this reverse feed condition engages the opposite or top surface of the cam track 44 and will remain in this position so long as the reverse feed button is depressed. Upon release of the reverse feed button, the helical spring 80 will urge the reverse feed button upwardly and at this same time the feed block spring 26 acting through the rock shaft 24 and linkage 22 will reverse the position of this link shaft 20 which in turn will cause the cam follower 42 to again engage the lower work surface 48 of the cam track 44. In this position the rock shaft 24 is again in its forward feed position.

Thus far described has been the normal forward feed and manual reverse feed for each back tacking in the operation of the sewing machine.

As previously mentioned, this invention is directed to an automatic back tacking mechanism, which means that the machine will automatically stay in reverse for a prescribed number of stitches of a prescribed stitch length once the reverse feed button has been depressed, whereupon the machine will automatically return to its forward feed for the conventional forward feed stitching. This will occur at one stitch length setting of the selector ring 66.

To accomplish this automatic feature, the bottom of web 98 of the cylindrical stitch control cam member 46 is provided with a second cam track 100 which is more clearly shown in FIG. 6. Within the cam track 100 is a cam follower 102 which is affixed to a latching lever 104. Latching lever 104 is pivoted about a pivot stud 106 suitably threaded into the bed portion 34 and is stabilized at the other end by second pivot stud 108 also threaded in the bed portion 34, both of which are clearly shown in FIG. 4. The latter pivot member is located within an elongated slot 110 to permit lateral movement of the latch lever 104 in response to a helical spring 112, urging the lever toward the center of the cylindrical stitch control cam member 46. The latch lever is retained on the respective pivot members by E-rings 114.

The purpose of the latching lever 104 is to lock the rock arm 38 in its up or reverse feed position when the latter has rotated clockwise in response to the depression of the reverse feed button 68. Such a lock-up, as mentioned before, will occur when the feed control dial is set as a particular stitch length setting as, for example, at 12 stitches per inch.

Figure 5:
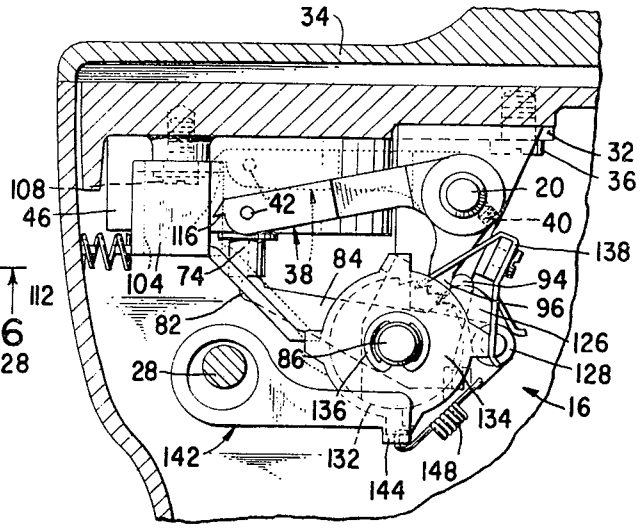
FIG. 5 is a bottom view of FIG. 4 taken along line 5—5 of FIG. 4.

To accomplish this lock-up function for the automatic back-tack feature of this invention, the aforementioned rock arm 38 is provided with a lip 116 which will rest on the latch lever 104 near the latter's inner edge adjacent to the elongated slot 110, when the latter is moved toward the rock arm 38 in response to the helical spring 112. This will occur only when the stitch selector ring 66 is set at the aforesaid preselected stitch length which positions the cam track 100, on the bottom of the web of the cylindrical stitch control cam member 46, so that the cam follower 102 may enter a node or reduced portion 118. See FIG. 6 where the node 118 is clearly shown and see FIG. 5 where the rock arm 38 is shown in phantom in its lock-up position. Obviously, when the rock arm 38 is in its upward position, the rock shaft 24 is in a reverse stitch or back-tack condition and will back-tack a preselected number of stitches and the mechanism for providing the preselected number of stitches will now be described.

The depression of the reverse feed button 68, thus moving the lobe 82 of the reverse feed lever 84 downwardly, will cause an engagement of an ear 120 on the reverse feed lever with a pawl plate 122 journalled on the same shaft 86 as the reverse feed lever. The engagement of this pawl plate causes its initial movement in a counter-clockwise direction, as shown in FIG. 3, away from its place of rest where tab 124 engages an edge of the lower arm 90 of U-shaped bracket 32. This rotation of the pawl plate 122 initially actuates a pawl 126 suitably journalled on a shaft 128 in an aperture 130 in the pawl plate 122. Being offset the center of rotation of the pawl plate 122, the pawl 126 also moves in a counter-clockwise direction in engagement with a ratchet wheel 132 also journalled for rotation on the shaft 86. Initial movement of this ratchet wheel 132 also rotates a four-lobed cam 134 to which it is fixedly attached, causing the latter to rotate the same amount. The pawl plate 122, ratchet wheel 132, and the four-lobed cam 134 are all locked on the shaft 86 by an E-ring 136 and the pawl plate 122 is spring biased toward the ratchet wheel 132 by a leaf spring 138 suitably affixed to the U-shaped bracket 32 on an ear 140 provided for that purpose. The leaf spring 138 has leaves engaging the pawl, one near the ratchet engaging end and the other near the rear of the pawl, to urge the pawl forward in engagement with the ratchet wheel and one leaf for engaging the four-lobed cam to provide sufficient friction to the four-lobed cam and ratchet wheel so that the pawl and the pawl plate will suitably control the latter.

Once the initial ratchet action has been started by the tilt of the reverse feed lever 84, continued actuation of the ratchet wheel 132 and the four-lobed cam 134 is provided by a connecting link drive 142 having an ear 144, the top of which normally rests on one of the lobes of the four-lobed cam but which is nudged off the lobe by the initial rotation of the four-lobed cam (the lowest one as shown in FIG. 3). Prior to being nudged off the lobe, even though the connecting link drive is continuously oscillated in response to an eccentric 146 on which it is journalled, the oscillation had no effect. The eccentric 146 is mounted on the bed shaft 28 and rotates therewith continuously when the rest of the sewing machine mechanisms are actuated. At this time the lowest lobe moved, a spring 148 attached at one end to the ear 144 and at the other end to the pawl plate 122 causes the ear 144 to engage the working surface between the lobes of the four-lobe cam. At the same time the forward edge of the ear 144 will engage a lip 150 on the pawl plate 122, causing the latter to rotate counter-clockwise incrementally each time the connecting link drive 142 is oscillated by the eccentric 146. This action also causes the pawl plate 122 to increment the ratchet wheel a preselected number of times, such as six, until the ear 144 is again lifted off the working surface four-lobed cam by the next succeeding lobe; the four-lobed cam having thus traveled 90°. Lifting of the ear 144 onto the next lobe disconnects the connecting link drive 142 from the pawl plate 122, stopping rotation of the ratchet wheel by neutralizing the effect of the eccentric 146. At the same time, another lobe on the four-lobed cam, 90° from the lobe which neutralized the connecting link drive, engages and forces an arm 152 on the latch lever 104, as well as the lever itself, back against the helical spring 112, permitting the rock arm 38 to rotate counter-clockwise in response to the feed block spring 26 acting on the rock shaft 24.

From the foregoing, it can be seen that the combination of the pawl plate 122, pawl 126, ratchet wheel 132 and connecting link drive 142 is a mechanism for maintaining the rock arm 38 in an upward position for a preselected length of time until the latter can be freed by disengagement of the latch lever 104 to place the feed block controlled by the rock shaft 24 into a forward stitch position. It should be pointed out also that the foregoing combination is engaged each time the rock arm 38 is rotated to a reverse feed position in response to the depression of the reverse feed button and the ratchet wheel 132, is incremented a prescribed number of times, but since the second cam track 100 located on the web 98 of the cylindrical stitch control cam member 46 is not in a position where the node 118 is opposite the cam follower 102, the latch lever 104 is unable to move to lock up the rock arm 38 so that the rotation of the ratchet wheel 132 has no effect. The ratchet wheel 132, as before, will rotate until the four-lobed cam has rotated 90° under the influence of the eccentrically actuated camming link drive 142 where it will again stop and be in a position for operation of the automatic back-tack at the selected stitch position.

What is claimed is:

1. In a sewing machine having a frame and a work supporting surface, a work feed system for moving work fabric transversely across said work supporting surface including a feed regulator shaft rotatably mounted in said frame and adapted to influence the movement imparted to the work fabric, a feed control mechanism operatively connected to said feed regulator shaft for controlling the angular position of the same and thus determining the incremental distances and direction which said work fabric is moved by said work feed system, said feed control mechanism comprising;

a stitch length control camming member including a cam track, means for selectively positioning said camming member so as to position said cam track to establish said incremental distances and thereby the stitch length as well as the direction said work fabric is moved, a cam follower and a rock arm responsive to the position of said cam track, said rock arm being operatively connected to said feed regulator shaft to move the latter angularly, means manually operable to move said rock arm thereby moving said feed regulating shaft to cause the reversal of movement of said work from the direction of movement established by said stitch length camming members, latching means responsive to said manually operable means to lock said rock arm and feed regulating shaft in said reverse position, and means for releasing said latch means after said work has been transported a predetermined number of incremental distances.

2. The machine according to claim 1 wherein said stitch length camming member further includes a second cam track, a second cam follower on said latching means responsive to the position of said second cam track, said second cam track so constructed and arranged so as to permit operation of said latching means at one selected position of said stitch length control camming member and preventing operation of said latch means at other positions of said stitch length control camming means.

3. The machine according to claim 2 wherein said latching means comprises a lever which engages a lip on said rock arm.

4. The machine as claimed in claim 3 wherein said means for releasing said latch means comprises a ratchet wheel actuated by means forming part of said work feed system, and means responsive to the actuation of said ratchet wheel for moving said latching means away from said rock arm.

5. The machine as claimed in claim 4 wherein said means responsive to the actuation of said ratchet wheel comprises a latch cam wheel engaging means on said lever arm.

* * * * *